US006467889B2

(12) United States Patent
Miyazaki et al.

(10) Patent No.: US 6,467,889 B2
(45) Date of Patent: Oct. 22, 2002

(54) INK TANK AND METHOD OF MANUFACTURE THEREFOR

(75) Inventors: Kyota Miyazaki, Kawasaki; Masami Ikeda, Tokyo; Osamu Sato, Chigasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/892,524

(22) Filed: Jun. 28, 2001

(65) Prior Publication Data

US 2001/0035895 A1 Nov. 1, 2001

Related U.S. Application Data

(62) Division of application No. 09/459,476, filed on Dec. 13, 1999, now Pat. No. 6,276,789.

(30) Foreign Application Priority Data

Dec. 21, 1998 (JP) ..... 10-362451
Dec. 1, 1999 (JP) ..... 11-342119

(51) Int. Cl.[7] ..... B41J 2/175
(52) U.S. Cl. ..... 347/86
(58) Field of Search ..... 347/49, 85, 86, 347/87

(56) References Cited

U.S. PATENT DOCUMENTS

| | | | | |
|---|---|---|---|---|
| 5,619,239 A | | 4/1997 | Kotaki et al. | 347/86 |
| 5,734,401 A | | 3/1998 | Clark et al. | 347/86 |
| 5,751,319 A | | 5/1998 | Robertson et al. | 347/85 |
| 6,086,193 A | * | 7/2000 | Shimada et al. | 347/86 |
| 6,293,662 B1 | | 9/2001 | Shihoh et al. | 347/86 |

FOREIGN PATENT DOCUMENTS

| | | |
|---|---|---|
| EP | 816098 | 1/1998 |
| EP | 847866 | 6/1998 |
| EP | 850766 | 7/1998 |
| JP | 10-44454 | 2/1998 |

OTHER PUBLICATIONS

U.S. patent application Ser. No. 09/231,252, filed Jan. 15, 1999.

* cited by examiner

*Primary Examiner*—Anh T. N. Vo
(74) *Attorney, Agent, or Firm*—Fitzpatrick, Cella, Harper & Scinto

(57) ABSTRACT

An ink tank comprises a housing detachably mountable on a liquid jet recording apparatus, which is capable of retaining liquid directly in the interior thereof, a supply portion for supplying liquid retained in the housing to the recording apparatus and a communication portion with the air outside for communicating the interior of the housing with the air outside. For this ink tank, the supply portion and the communication portion with the air outside are integrally formed, and at the same time, a plate member is provided to make the interior of the housing a closed space by joining the plate member to the housing, and then, erroneous installation prevention portions are arranged for the plate member to prevent the installation on the position other than specifically designated for the liquid jet recording apparatus. With the structure thus arranged, the ink tank makes it possible to easily enhance the dimensional precision of the coupling portion with the recording apparatus, and the erroneous installation prevention portions as well. Thus, without depending on the precision of an ink tank as a whole, it is possible to enhance the reliability of the installation on or coupling with the recording apparatus.

5 Claims, 12 Drawing Sheets

INK TANK AND METHOD OF MANUFACTURE THEREFOR

This is a division of parent application Ser. No. 09/459,476, filed Dec. 13, 1999, now U.S. Pat. No. 6,276,789.

BACKGROUND OF THE INVENTION

1. Field of the Invention

The present invention relates to an ink tank for a liquid jet recording apparatus that records by discharging ink. More particularly, the invention relates to an ink tank having a plurality of joint portions with respect to the ink jet printing system that consumes a large amount of ink.

2. Related Background Art

An ink tank (a liquid container) used for an ink jet recording apparatus is structured to be detachably mountable on an ink tank unit, which is an ink tank installing portion of the recording apparatus, in order to make it easier to exchange ink tanks when ink is consumed. For the ink tank, the ink supply port is arranged with a rubber plug or the like for the prevention of ink leakage when dealing with the ink tank as an individual body at the time of deliver or exchange thereof. At the same time, a hollow needle or the like is arranged for the ink tank unit for use of the connection with the ink tank, which makes the ink supply possible from the ink tank when it is connected with the ink supply port of the ink tank.

For the inner structure of the ink tank, there have been known various modes, such as the one that retains ink in the sponge or the some others material that generate capillary force, the one that retains ink in a flexible bag, or the one that retains ink directly in a rigid housing. Particularly, for the recording apparatus arranged to make a steady ink supply by keeping the water head difference constant between the head and the liquid surface of the tank by use of tubes or the like to connect the recording head and the ink tank, it is preferable to adopt the structure arranged to contain ink directly in the tank housing also from the viewpoint that this structure makes the reduction of part numbers possible.

The ink tank that adopts the aforesaid structure is provided with the communication port with the air outside for releasing the interior of the housing to the atmosphere when supplying ink. This communication port with the air outside is also sealed with closing means, such as a rubber plug, in order to prevent the ink leakage or the like when the ink tank is handled as an individual body. This closing means is arranged to be released when the ink tank is installed on the ink tank unit side.

However, for a larger type ink jet recording apparatus that consumes a large amount of ink due to the higher printing duty, a large capacity ink tank, such as 500 cc or more, is often used so as to suppress the frequency of the ink tank exchanges. Here, however, in order to adopt the aforesaid structure for such a large capacity ink tank as described above, it is required to manufacture the container itself in higher precision for the implementation of the reliable connection if the positioning section of the installation to the tank unit should be located away from the jointing portion, such as ink supply port or the communication port with the air outside. Here, a larger hollow container, which is capable of storing liquid directly in the interior thereof, is usually made with plastic by the blowing formation so as to provide the container at lower costs. Therefore, it is difficult to improve the dimensional precision of the container while maintaining the lower costs as usual.

Further, in recent years, it has been required to use plural kinds of ink having different densities or colorants for the implementation of the highly precise recording in higher image quality by use of the aforesaid apparatus. As a result, it is also required for the tank itself to be provided with a mechanism to prevent erroneous installation so that there is no possibility that a wrong ink tank is installed on the tank unit. As to such mechanism to prevent the erroneous installation, too, a higher precision is required, as the kinds of ink tanks, which should be installed on one tank unit, are increased. Then, for the recording apparatus for use of medical equipment, for use of the CAD outputs, for use of poster outputs, or for use of some other special purposes, it is required to make the precision higher still eventually for the mechanism on the tank side to prevent the erroneous installation if the tank unit should be arranged to be shareably usable by each of the apparatuses for the implementation of the lower-cost manufacture thereof, because the kinds of tanks that should be discriminated from one another become many inevitably in this case.

SUMMARY OF THE INVENTION

Of the two subjects discussed above, some of the inventors hereof have already filed the patent application as to the coupling method of an ink tank and an ink tank with a view to solving the problems encountered in making the ink tank larger. In this respect, the inventors hereof have further studied the subjects as a whole. On the basis of the new findings after such studies, the invention here of is designed.

It is an object of the invention to provide a highly reliable large ink tank capable of storing liquid directly in it with a comparatively simple structure with a smaller amount of variations of dimensional precision per product at lower costs by dealing with the two subjects related to the installation and coupling with the tank unit at a time. It is also the object of the invention to provide a method for manufacturing such ink tank.

In order to achieve the objects described above, the ink tank of the present invention comprises a housing detachably mountable on a liquid jet recording apparatus, which is capable of retaining liquid directly in the interior thereof; a supply portion for supplying liquid retained in the housing to the recording apparatus; and a communication portion with the air outside for communicating the interior of the housing with the air outside. For this ink tank, the supply portion and the communication portion with the air outside are integrally formed, and at the same time, a plate member is provided to make the interior of the housing a closed space by joining the plate member to the housing, and then, erroneous installation prevention portions are arranged for the plate member to prevent the installation on the position other than specifically designated for the liquid jet recording apparatus.

Also, the method of the present invention for manufacturing an ink tank, which is provided with a housing detachably mountable on a liquid jet recording apparatus, at the same time, being capable of retaining liquid directly in the interior thereof; a supply portion for supplying liquid retained in the housing to the recording apparatus; and a communication portion with the air outside for communicating the interior of the housing with the air outside, comprises the steps of preparing a plate member provided with the supply portion and the communication portion with the air outside on the same surface, at the same time, being provided with erroneous installation prevention portions for preventing the installation on the position other than specifically designated for the liquid jet recording apparatus, the plate member being joined to the housing for making the interior of the housing a closed space; positioning the plate member with respect to the housing; welding the plate member to the housing. For this method of manufacture, the plate member is positioned in two directions orthogonal to the joining direction of the liquid jet recording apparatus, at the same time intersecting each other with respect to the housing in the step of positioning.

Also, the method of the present invention for manufacturing an ink tank, which is provided with a housing detachably mountable on a liquid jet recording apparatus, at the same time, being capable of retaining liquid directly in the interior thereof; a supply portion for supplying liquid retained in the housing to the recording apparatus; and a communication portion with the air outside for communicating the interior of the housing with the air outside, comprises the steps of preparing an ink tank provided with a plate member provided integrally with erroneous installation prevention portions for preventing the installation on the position other than specifically designated for the liquid jet recording apparatus, the supply portion, and the communication portion with the air outside, at the same time, making the interior of the housing a closed space by being joined to the housing; and injecting ink through either one of the communication portion with the air outside and the supply portion of the ink tank, at the same time, exhausting the air in the interior of the housing from the other portion to the outside of the housing.

In accordance with the ink tank and the method for manufacturing the ink tank described above, it becomes possible to easily enhance the dimensional precision of the coupling portion with the recording apparatus, as well as that of the erroneous installation prevention portions. Therefore, without depending on the precision of an ink tank as a whole, it is possible to enhance the reliability of the installation on or coupling with the recording apparatus.

BRIEF DESCRIPTION OF THE DRAWINGS

FIG. 6A is a plan view of the ink tank; FIG. 6B, a side view thereof; and FIG. 6C, a three-dimensional perspective view thereof.

FIG. 7A is a cross-sectional view of the plate member (taken along line 6B—6B in FIG. 6A); FIG. 7B, a cross-sectional view of the vicinity of the connecting portion of the housing with the plate member (taken in line 6B—6B in FIG. 6A); FIG. 7C, a bottom view which shows the plate member; and FIG. 7D, a plan view which shows the vicinity of the connecting portion of the housing with the plate member.

DETAILED DESCRIPTION OF THE PREFERRED EMBODIMENTS

Hereinafter, with reference to the accompanying drawings, the description will be made of the embodiments in accordance with the present invention.

Figure 1:
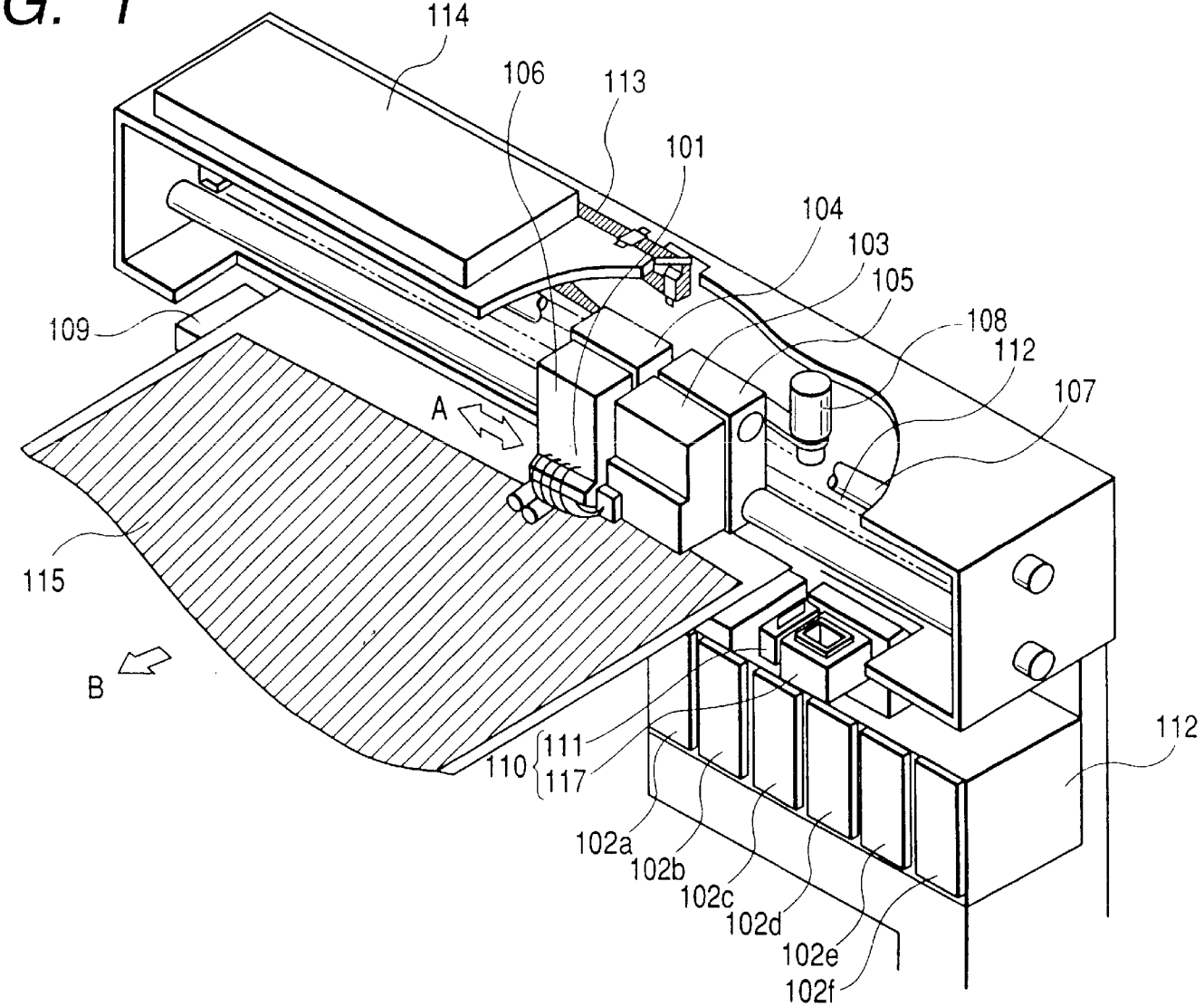
FIG. 1 is a perspective view which shows the outer appearance os an ink jet recording apparatus in accordance with one embodiment of the liquid jet recording apparatus to which the-present invention is applicable.

At first, in conjunction with FIG. 1, the description will be made of an ink jet recording apparatus capable of mounting the ink tank of the present invention. FIG. 1 is a perspective view which shows the outer appearance of an ink jet recording apparatus, one embodiment of the liquid jet recording apparatus for which the present invention is applicable.

As shown in FIG. 1, the head carriage 104 and the supply carriage 105, which are freely slidable in the directions indicated by an arrow A, are fitted onto the two main scanning rails 107 which are arranged in parallel with each other. For the head carriage 104, the discharge head unit 101 is mounted to discharge ink in accordance with the recording signals.

The discharge head unit 101 is provided with a plurality of nozzles each arranged in line per color, respectively, corresponding to six color ink, that is, dark cyan, light cyan, dark magenta, light magenta, yellow, and black. Each of the nozzles is provided with the electrothermal transducing element that generates thermal energy for use of ink discharges, respectively. In the discharge head 101, ink is supplied by means of the capillary phenomenon in the nozzles. Then, ink forms meniscus on the surface where each of the nozzles of the discharge head 101 is open (hereinafter, referred to as the "nozzle surface"), and keeps condition that each nozzle is filled with ink. Also, the discharge head unit 101 is covered by the head cover 106 together with the driving substrate that drives the discharge head unit 101. The driving substrate of the discharge head 101 is connected by way of the flat cable 113 with the substrate box 114 that houses the control substrate or the like that controls the operation of the recording apparatus as a whole.

On the other hand, the sub-tank 103, which is used for supplying ink to the discharge head unit 101, is mounted on the supply carriage 105. The interior of the sub-tank 103 is divided into 6 chambers, each corresponding to ink of each color. Then, each of the chambers is connected with the corresponding discharge head unit 101 by use of the resin tube. Further, below the sub-tank 103, six ink tanks 102 which contain ink to be supplied to the sub-tanks 103 are held in the ink tank unit 120 which will be described later. In FIG. 1, the detailed structure of the ink tank unit is omitted.

The ink tank 102 has a larger capacity than the sub-tank 103. In accordance with this example, the ink tank can contain ink of 500 to 1000 $cm^3$. Each of the ink tanks 102 is arranged corresponding to ink of each color, and by means of the resin tubes, it is connected with each of the chambers of sub-tank 103. In this manner, ink retained in the ink tank 2 is supplied to the sub-tank 103, and held in the interior of the sub-tank 103. Further, from the sub-tank 103, ink is supplied to the discharge head unit 101.

The head carriage 104 and the supply carriage 105 are connected with the timing belt, respectively, and arranged to reciprocate for scanning in the directions indicated by the arrow A along with the timing belt which rotates by means of the main scanning motor 108. In the position that faces the nozzles of the discharge head unit 101, the platen 109 is arranged. The recording sheet 115 is carried on the platen 109 in the direction indicated by an arrow B. The conveyance of the recording sheet 115 is made intermittently by the specific pitches per scan of the head cart unit, during which ink is discharged from the discharge head unit 101 for recording.

Also, in the scanning area of the discharge head unit 101 but outside the recording area of the recording sheet 115, the head recovery system 110 is arranged to face the discharge head unit 101 in order to maintain the discharge characteristics of the ink discharges of the discharge head unit 101. The head recovery system 110 is provided with the cap 117 that caps the discharge head unit 101, and also, with the blade 111 that cleans the nozzle surface of the discharge head unit 101. The position of the discharge head unit 101, in which the discharge head unit 107 faces the cap 117, is called the "home position".

Figure 2:
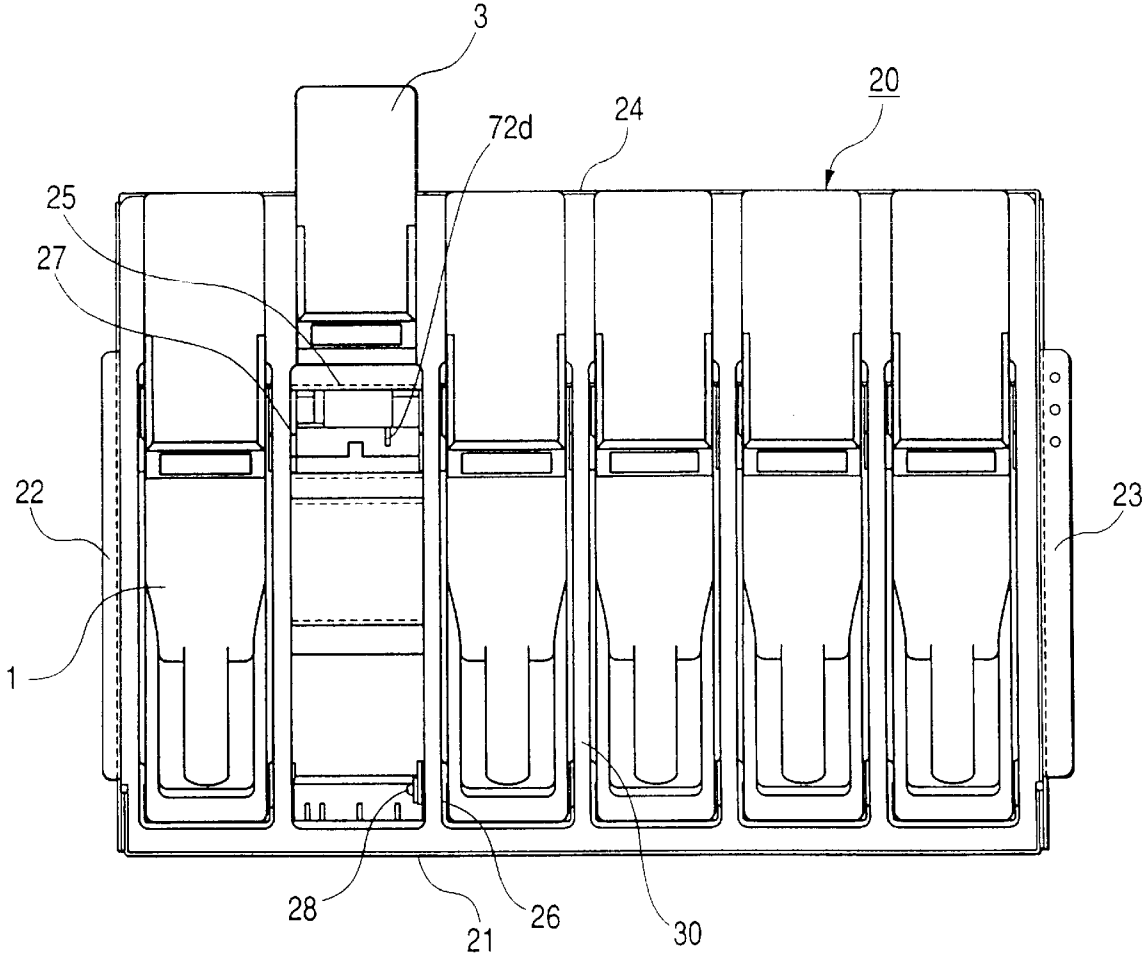
FIG. 2 is a front view which shows the main tank unit capable of mounting the ink tank of the present invention.
Figure 3:
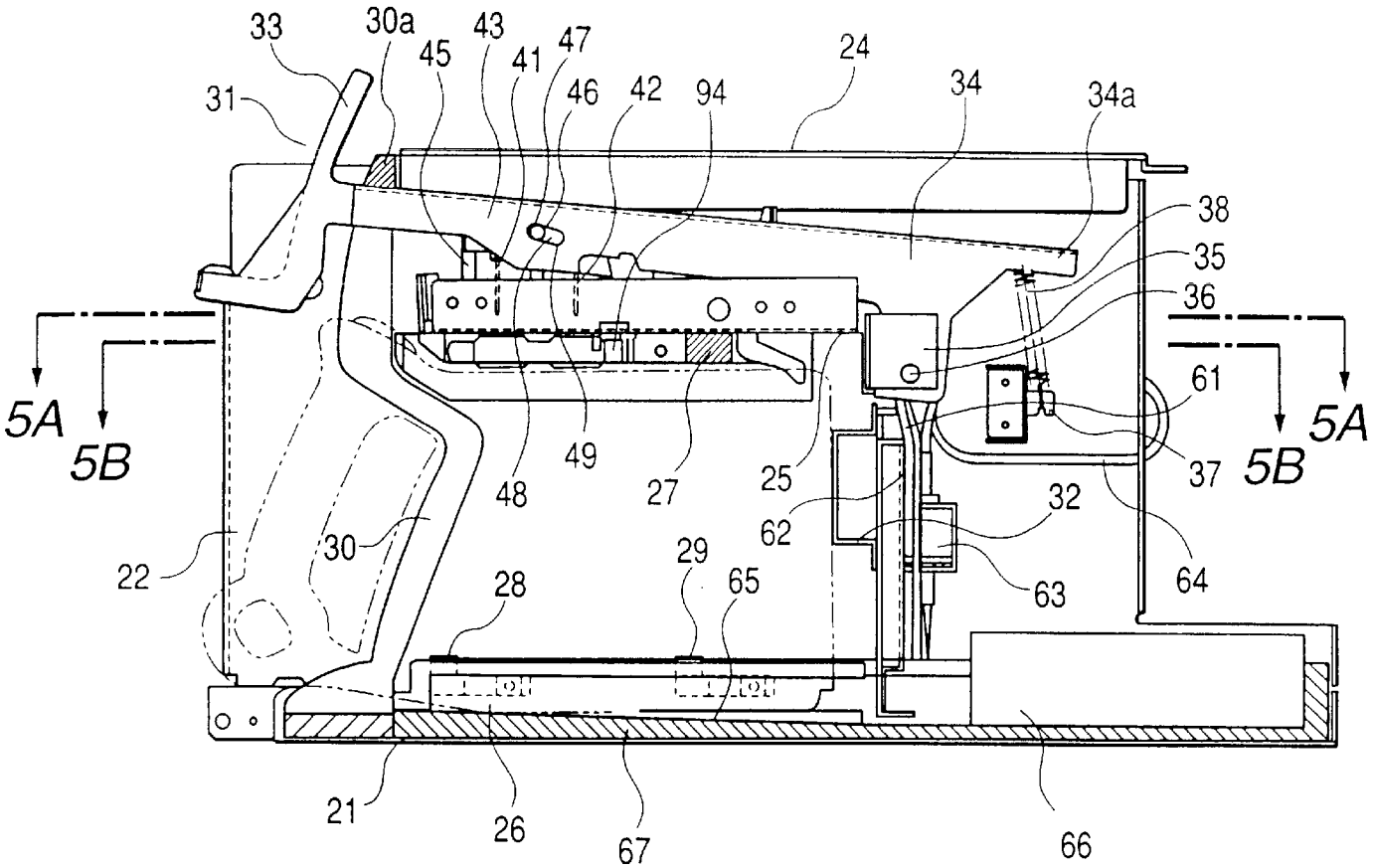
FIG. 3 is a side sectional view which shows the main tank unit capable of mounting the ink tank of the present invention.
Figure 4:
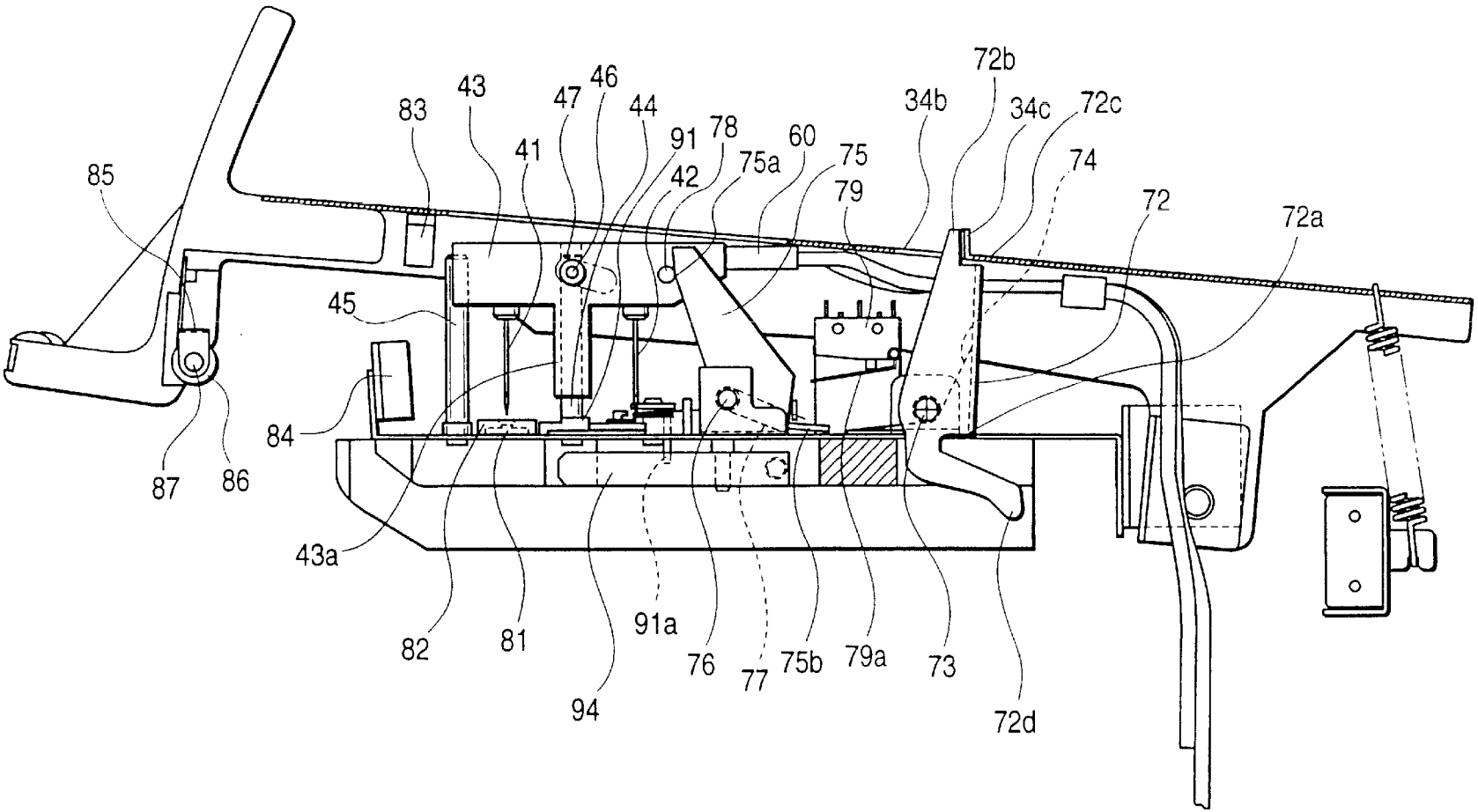
FIG. 4 is a side sectional view which illustrates the principal part of the main tank unit capable of mounting the ink tank of the present invention shown in FIG. 3.
Figure 5A:
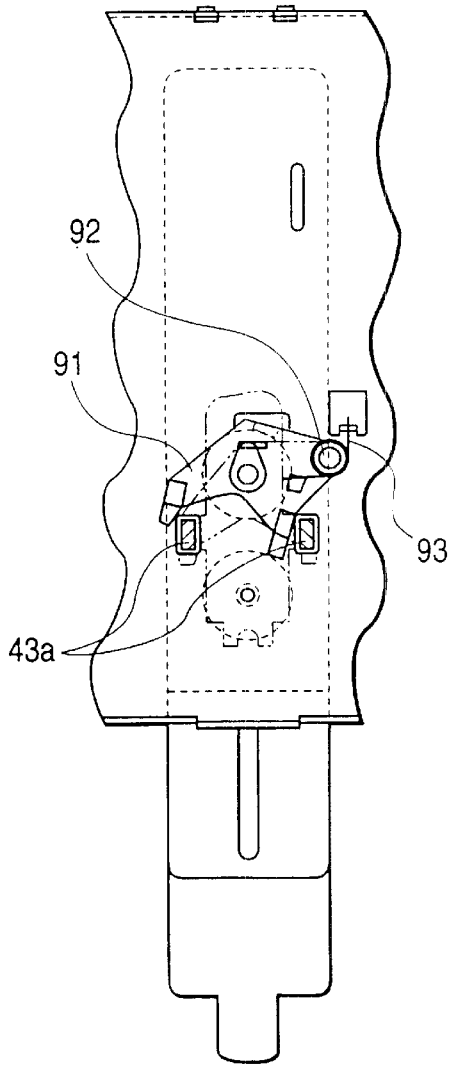
FIGS. 5A and 5B are cross-sectional views of the main ink tank unit shown in FIG. 2 which is capable of mounting the ink tank of the present invention, taken along line 5A—5A and line 5B—5B.
Figure 5B:
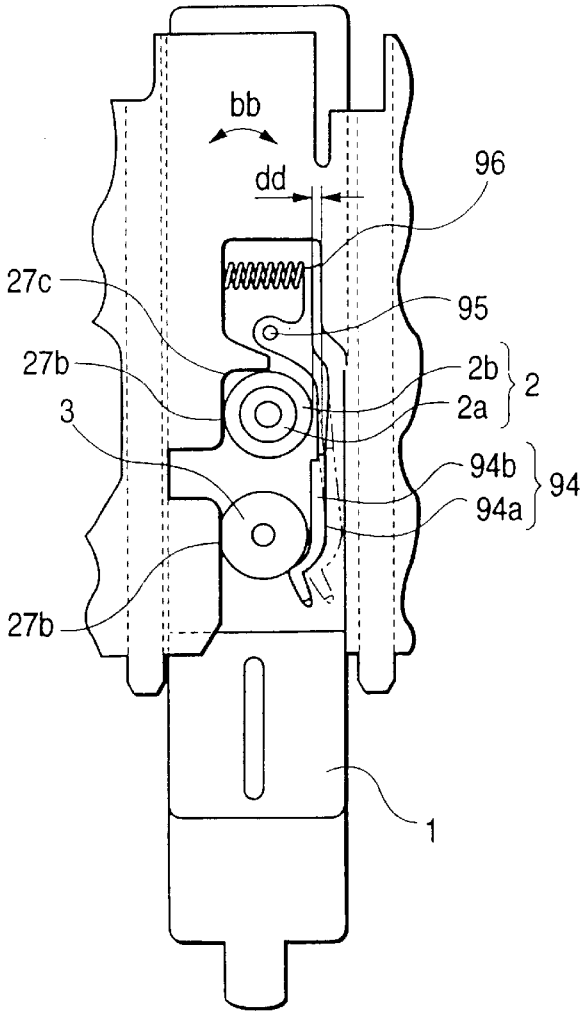

Now, in conjunction with FIGS. 2 to 4, 5A and 5B, the description will be made of the ink tank unit which serves as holding means that stores the ink tank of the liquid jet recording apparatus, which is preferably adopted for the ink tank of the invention herein. FIGS. 2 and 3 are views which illustrate the ink tank unit of the present invention as a whole. FIG. 2 is a front view of the ink tank unit 20. FIG. 3 is side sectional view which illustrates it. Also, of the ink tank structure shown in FIG. 3, FIG. 4 shows its principal part. Then, FIGS. 5A and 5B are cross-sectional views which illustrate the ink tank unit shown in FIG. 3, taken along line 5A—5A and line 5B—5B, respectively.

In accordance with the present embodiment, the ink tank unit 20 contains one ink tank 1 or a plurality thereof (here, the case where six tanks are contained is exemplified). On the bottom of the housing of the ink tank unit 20, the bottom plate 21 is arranged, and on the upper part, the upper face plate 24 is arranged. The both ends of each of them are connected by means of the left chassis 22 and the right chassis 23. Between the bottom plate 21 and the upper face plate 24, each of the central plate 25 is bridged across the left chassis 22 and the right chassis 23, and together with the rear chassis 32 and the like, it contributes to enhancing the robustness of the housing.

A reference numeral 26 designates the lower guide that guides the bottom portion of the ink tank 1; 27, the upper guide that guides the upper portion thereof. On the right side of the recessed portion of the lower guide 26 where the ink tank is contained, the tank biasing springs 28 and 29 are arranged to function as the second biasing means that biases it to the second reference surface, hence positioning the lower part of the ink tank 1 by pressing the ink tank 1 to the left side. Each of the adjacent ink tank containing portions is partitioned by the front guide 30 so that it is arranged to enable the operator to recognize the inserting place at a glance when inserting the ink tank A reference numeral 31 designates the tank lock lever. When the ink tank 1 is not housed, the lever is lifted upward, but when the operator presses it downward after the ink tank 1 is inserted, hence locking it so that the ink tank 1 can not be withdrawn.

Then, as to the ink tank unit that contains ink of plural colors, the longitudinal direction of the ink tank is in agreement with the direction of insertion into the ink tank unit, thus enhancing the space efficiency.

The tank lock lever 31 is formed by the lever grip 33 that the operator handles, and the lever main body 34. The tank lock lever 31 is rotatively supported by the lever supporting member 35 centering on the lever shaft 36 provided therefor. The lever supporting member 35 is fixed to the central plate 25. Then, the tension spring 38 is provided between the spring hooks 37 arranged between the end portion 34*a* of the lever main body 34 on the side opposite to the lever grip 33, the left chassis 22, and the right chassis 23. Therefore, the tank lock lever 31 is always biased in clockwise centering on the lever shaft 36. Thus, when the ink tank 1 is not inserted, the tank lock lever is held in a state where it abuts upon the abutting portion 30*a* of the front guide.

Reference numerals 41 and 42 designates the tubular needles each having thin and acute tip, respectively. The needle 41 is the ink supply needle which is connected with the ink supply port of the ink tank 1 to suck ink from the interior thereof. The needle 42 is the needle communicated with the air outside, which is used to enable the interior of the ink tank to be communicated with the atmosphere when connected with the atmosphere communication port of the ink tank 1. Each of the needles 41 and 42 is held by the needle holder 43, respectively. The needle holder 43 is movable along the column type guide shafts 44 and 45 planted on the central plate 25.

On both sides of the needle holder 43, there are arranged a pair of pins 46 and the rollers 47 which are rotative outside the pins. The rollers 47 are fitted into the shaft bearing members 49 arranged on both sides of the lever main body 34. With the structure thus arranged, the needle holder 43 and the needles 41 and 42 can be lowered by depressing the tank lock lever 31.

The needles 41 and 42 are bent in the needle holder 43 in the L-shaped form, respectively, and connected with each of the tubes 61 and 62 by means of the rubber needle joint 60. The tube 61 is connected with the sub-tank through the check valve 63 that checks the reverse flow of ink from the sub-tank side, and the tube 64 as well. Here, on the way of tube 64, a pump is arranged for use of carrying ink liquid. The tube 62 is draw around to the back side of the rear chassis 32, and the tube end is open to the atmosphere. Therefore, when operating the pump, the check valve 63 is open to carry ink from the ink tank 1 to the sub-tank. In place thereof, the air is then supplied into the interior of the ink tank 1 through the tube 62.

On the center of the ink tank housing unit of the lower guide 26, the inclined groove 65 is arranged from the entrance of the ink tank to the depth side thereof. Further on the depth side, the ink absorbent 66 is arranged to be connected in the alignment direction of the ink tank 1. The ink absorbent 66 is prepared for absorbing ink at least for an amount equivalent to one ink tank portion. Even if the ink tank 1 should be broken unexpectedly to cause ink to leak, there is no possibility that such ink is overflown outside the unit. The angle of the inclined groove 65 is set at 1.5° for the present embodiment so that the ink that leaks out should flow in the direction of the absorbent 66 immediately.

A reference numeral 72 designates the lever lock member which is supported to be swinging centering on the supporting shaft 73, and biased in the clockwise direction by means of the torsion spring 74. When the ink tank 1 is not housed, the lever lock member 72 is held in the state the abutting portion 72*a* abuts upon the central plate 25 (see FIG. 2). Then, the upper end portion 72*b* of the lever lock member 72 penetrates the aperture 34*b* of the lever main body 34. In this state, therefore, if it is intended to press down the tank lock lever 31, the folded portion 34*c* of the lever main body 34 abuts upon the shoulder portion 72*c* of the lever lock member 72 so as not to allow the tank lock lever 31 to be lowered any more.

A reference numeral 75 designates the detection plate which is rotatively supported centering on the supporting shaft 76, and biased in the counterclockwise direction by means of the torsion spring 77. The abutting portion 75*a* of the detection plate 75 abuts upon the holder pin 78 planted on the needle holder 43. Then, when the needle holder 43 descends to the specifically set lowest position, the detection plate rotates in the counterclockwise direction so that the extruded portion 75*b* presses the microswitch 79 of the detection unit 79*a*, hence sensing the movement of the needles 41 and 42 to the predetermined positions.

A reference numeral 81 designates the absorbent that wipes off the ink that adheres to the needle 41 when the needle 41 is withdrawn from the ink tank 1, which is held by means of the absorbent holder 82. A reference numeral 83 designates the convex member which is provided for the lever main body 34 to engage with the concave member 84 fixed to the central plate 25. Both the convex member 83 and the concave member 84 are formed by an elastic material, such as polyacetal or polypropylene, and when the tank lock lever 31 is depressed, these members are coupled to hold the tank lock lever 31 in that position. The coupling thereof is released if the lever is pulled up by the stronger force than predetermined. Also, the plate spring 85, the roller 86, and the rotational shaft 87, which serve as tank biasing means, are provided for the lever main body. One end of the plate spring 85 is fixed to the lever grip 33. Then, the idler roller 86 and the rotational shaft 87 are provided for the other end thereof.

The stopper 91 is rotative centering on the rotational shaft 92 planted above the central plate 25, which is biased by the torsion spring 93 in the counterclockwise direction (see FIG. 5A). The stopper 91 is placed just below the foot portion 43*a* of the needle holder 43 when the ink tank 1 is not housed. As a result, the needle holder 43 cannot descend any further.

A reference numeral 94 designates the click member which is rotative centering on the rotational shaft 95 planted downward from the central plate 25, and biased in the clockwise direction by means of the compression spring 96 (see FIG. 5B).

Also, a reference numeral 27*c* designated the abutting surface which serves as a first reference surface; 27*b*, the abutting surface which serves as a second reference surface. Both of them are arranged for the upper guide 27, respectively. The first reference surface and the second reference surface are orthogonal to each other. Then, the first reference surface is orthogonal to the inserting direction of the ink tank. Therefore, the second reference surface is parallel to both the inserting direction of the ink tank and the moving direction of the needle holder 43 which serves as means for moving the needle. Also, by means of the click member 94, the ink supply port and the communication port with the air outside, which serve as the extrusion of the ink tank, are allowed to abut upon the aforesaid abutting surfaces 27*b* and 27*c*. In this way, it becomes possible to shift the movable area of the first cap in the direction bb to the dd shown in FIG. 5B.

Also, in accordance with the present embodiment, it is arranged that the click member 94 is provided only for the portion equivalent to the cylinder 2*a* at the end portion 94*a* with respect to its height direction, and provided for the portions equivalent to both the cylinders 2*a* and 2*b* with respect to the arm portion 94*b*. Therefore, it is arranged so that the click member does not perform the clicking operation when the first extrusion which will be described later passes the end portion 94*a*.

For the present embodiment, when the ink tank 1 is inserted, the click member 94 makes the clicking operation only for the second extrusion, but not for the first extrusion. Thus, it is made easier for the user to confirm that the tank has been placed in the predetermined position by the one clicking operation. Also, in accordance with the present embodiment, the movable amount dd is defined by the distance between the arm portion of the click member and the cylinder 2*a* of the first extrusion. Therefore, the stable coupling can be implemented by regulating such movable amount.

As described above, it becomes possible for a larger container to enhance the positioning precision by positioning the coupling portion by means of the ink supply port. Also, it is possible for the user to easily detect this positioning shift by sensing the clicking thus provided, hence confirming the exact coupling of the ink tank. Also, when coupling the ink tank which is provided with a plurality of extrusions in the inserting direction, the front extrusion in the inserting direction is allowed to abut upon the first reference surface which is orthogonal to the inserting direction of the ink tank, and then, a plurality of extrusions are allowed to abut upon the second reference surface which is orthogonal to the first reference surface. In this manner, the positioning is made by suppressing play in the inserting direction without using space wastefully in order to implement the coupling more reliably for the ink jet recording apparatus that uses ink of plural colors.

The ink tank of the invention hereof can be utilized preferably for the recording apparatus and the ink tank unit described above. Now, in conjunction with FIGS. 6A to 6C and FIGS. 7A to 7D, the detailed description will be made of the specific structure thereof.

Figure 6A:
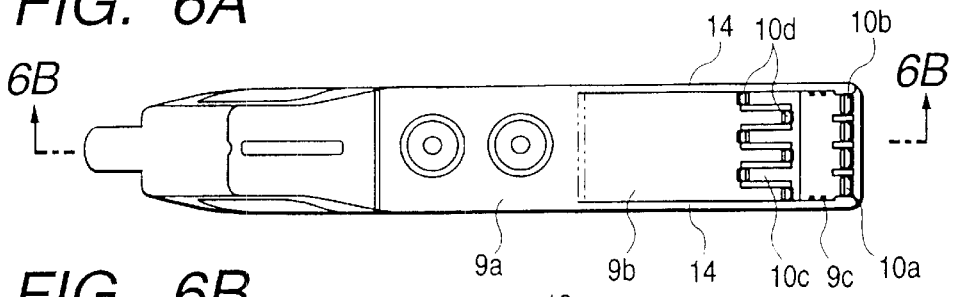
FIGS. 6A, 6B and 6C are views which illustrate the ink tank of the present invention.
Figure 6B:
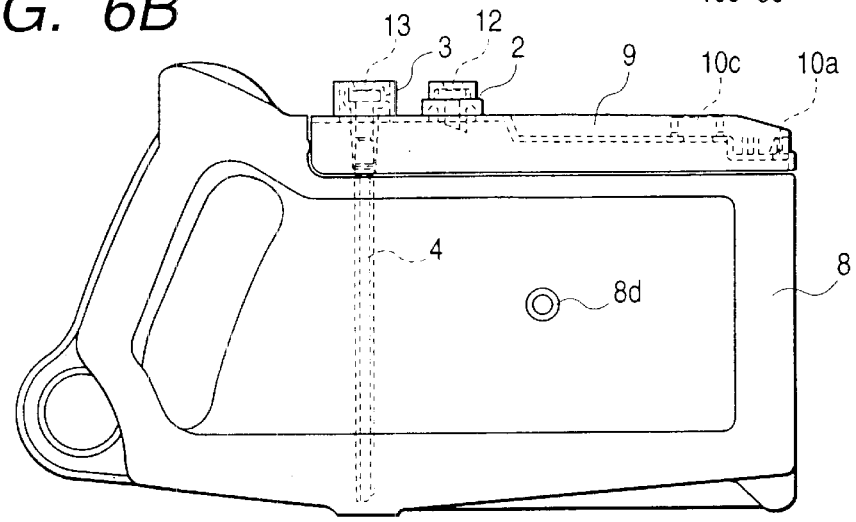
Figure 6C:
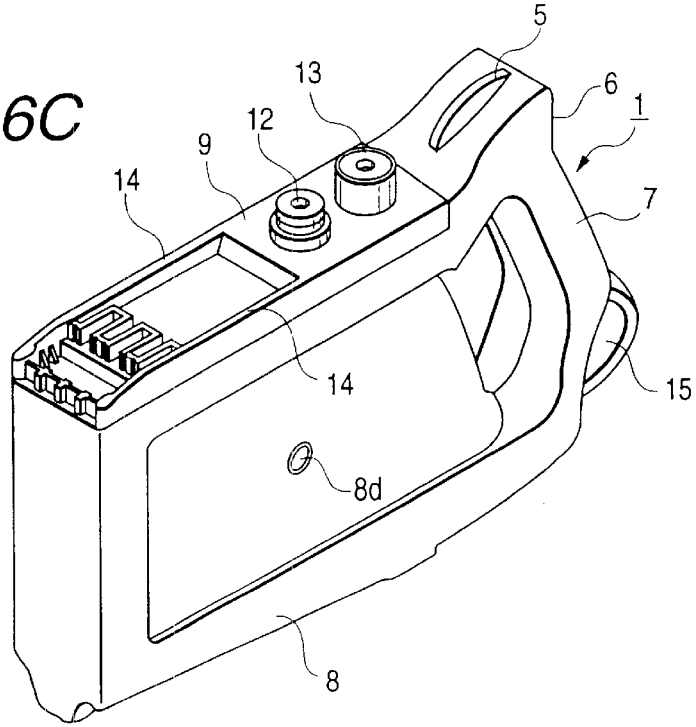

FIGS. 6A to 6C are views which illustrate the ink tank in accordance with the present invention. FIG. 6A is a plan view of the ink tank; FIG. 6B, a side view thereof; and FIG. 6C, a three-dimensional perspective view thereof.

The ink tank 1 is capable of containing liquid, such as ink, in the interior of the robust housing 8 directly, which comprises the first extrusion 2 having the communication port with the air outside 12 on the surface confronted with the bottom face for inducing the air outside into the interior of the housing; the second extrusion 3 having the ink supply port 13 for leading out liquid from the interior of the housing to the outside; the first erroneous installation prevention units 10*a* and 10*b*; and the second erroneous installation prevention units 10*c* and 10*d*. For the ink tank of the invention, the first extrusion 2 and the second extrusion 3 for use of coupling with the aforesaid ink tank unit, and the first and second erroneous installation prevention units are formed on one plate type plate member 9, which is fixed to the housing 8.

In accordance with the present embodiment, the cylinder 2*a* having the smaller diameter than the second extrusion 3, and the cylinder 2*b* having the same diameter as the second extrusion 3 are arranged coaxially for the first extrusion 2, and the height thereof is arranged to be the same as that of the second extrusion.

Here, the ink supply port and the communication port with the air outside are provided for the surface confronted with the bottom face. Then, since the needles of the main tank unit are inserted from above, there is no possibility that ink leaks from the coupled portion to stain the ink tank unit even if the coupling should be made insecurely at that time. The communication port with the air outside 12 and the ink supply port 13 are closed by the rubber plugs (not shown) in the extrusions, respectively, so as not to allow the inner liquid to leak out unexpectedly. Here, as shown in FIG. 6B, the tube 4 is provided for the ink supply port, which is extended to the vicinity of the bottom portion of the interior of the housing. Then, even in the posture shown in FIG. 6C, the tube is connected with the ink supply port, making it possible to suck the liquid contained in the interior of the housing from the outside, hence leading it out externally.

Also, in accordance with the present embodiment, the configurations of the first extrusion and second extrusion are almost cylindrical, respectively. Then, the arrangement thereof is such that the central axis of the first extrusion and that of the second extrusion are substantially in the identical forms, and that the first extrusion is in front of the second one. On the surface confronted with the bottom face on the second extrusion side (back side in the inserting direction), the inclined surface which is higher than the height of the end face of the opening portion of each extrusion is arranged, and at the same time, the rib 5 for use of protection is arranged to prevent the second extrusion 3 from being broken when dropping it off. Then, the end portion on the higher side of the inclined surface (the end portion on the back side in the inserting direction) is provided with the vertical face portion 6 in order to fix the ink tank to the lever of the main tank unit. This vertical face portion 6 presents the surface which is almost perpendicular to the bottom face and in parallel with the column portions of the first extrusion and the second extrusion. The lower end of the vertical face portion is extended down in the vertical direction to the portion slightly lower than the column portions of the first extrusion and the second extrusion. The upper end thereof is extended up slightly more than the opening portions of the first extrusion and the second extrusion.

Here, the height of the second extrusion is such as to be positioned lower than the line connecting the surface having the communication port with the air outside for the first extrusion with the upper part of the vertical surface portion. Therefore, the second extrusion is not directly in contact with the ground even if the tank should be fallen off, and there is no possibility that the second extrusion is broken by being dropped off. In accordance with the present embodiment, therefore, it is possible for the ink tank to be coupled securely with the recording apparatus which can mount the ink tank as described later by the protection of the ink supply port of the ink tank. In this respect, the aforesaid protection rib is not necessarily the constituent hereof. However, the provision of the rib makes it more secure to protect the second extrusion.

Below the vertical face portion, the handling portion 7 which is protruded from the vertical face portion, and the hooking hole 15 are arranged by the through holes that penetrate the housing, respectively. Thus, the user's operativity of the ink tank is enhanced such as to carry it or remove it from the ink tank unit. In accordance with the present embodiment, the handling portion and hooking hole are structured with the hollow body which is communicated with the interior of the housing where ink can be retained, and liquid can also be filled in them. As a result, the ink storage capacity of the ink tank can be increased to that extent.

Figure 7A:
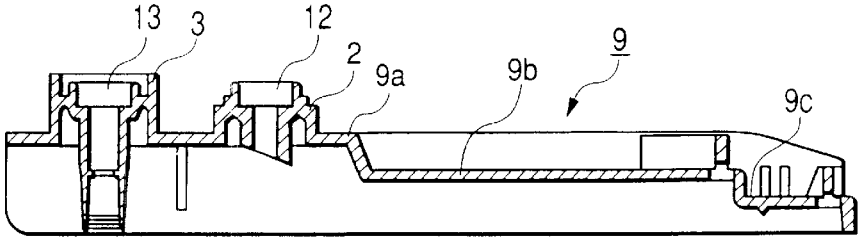
FIGS. 7A, 7B, 7C and 7D are views which illustrate the connecting portion between the plate member and the housing in accordance with the present invention.
Figure 7B:
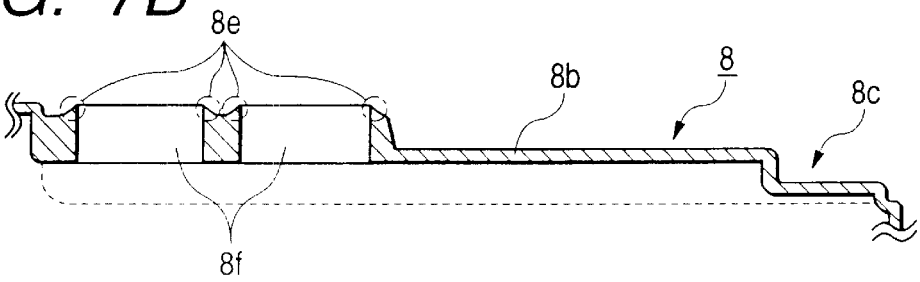
Figure 7C:
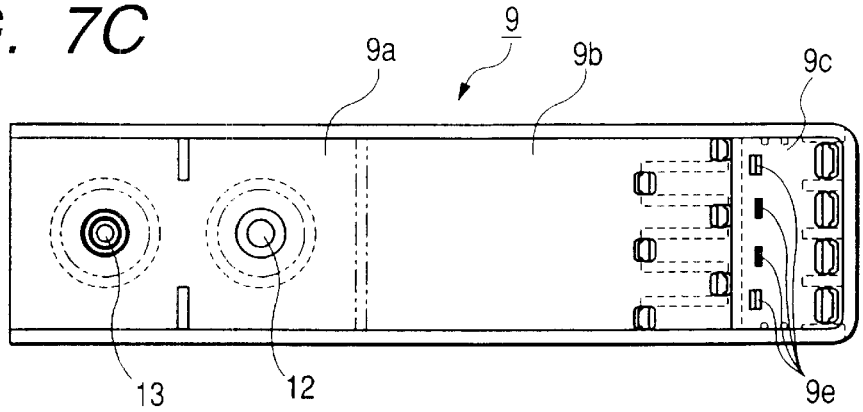

Now, further, in conjunction with FIGS. 7A to 7D, the detailed description will be made of the plate member, and the bonding of the plate member and the housing in accordance with the present embodiment. FIG. 7A is a cross-sectional view which shows the plate member of the present embodiment (which corresponds to the section taken along line 6B—6B in FIG. 6A); FIG. 7B, a cross-sectional view which shows the vicinity of the bonding portion of the housing with the plate member (which corresponds to the section taken along 6B—6B in FIG. 6A); FIG. 7C, a bottom view of the plate member; and FIG. 7D, a plan view of the vicinity of the bonding portion of the housing with the plate member.

The plate member 9 of the present embodiment is provided with flat surface portions 9*a*, 9*b*, and 9*c* having the respective steps as shown in FIG. 7A. Then, on the flat surface portion 9*a* which is farthest from the bottom face when bonded to the ink tank, the first extrusion 2 and the second extrusion 3 are arranged in such a manner that the first extrusion is placed on the end side of the plate member. Adjacent to the flat surface 9*a*, the second erroneous installation prevention portions 10*c* and 10*d* are arranged on the flat surface 9*b* which is lower than the flat surface 9*a* by one step. Then, the first erroneous installation prevention portions 10*a* and 10*b* are arranged on the flat surface 9*c* which is lower than the flat surface 9*b* by one step, and which becomes the end portion on the side opposite to the flat surface 9*a* of the plate member, having the flat surface 9*b* between them (the end portion on the front side in the installation direction of the aforesaid ink tank unit). Then, the reverse side of each of the flat surface portions (which is the portion bonded to the housing) is configured to be the flat plane corresponding to each of the flat surface portions, respectively. Further, on the on the reverse side of the flat surface portion 9*c*, the welded rib 9*e* is arranged on the position away from the erroneous installation prevention portions 10*a* and 10*b* as shown FIG. 7C.

In this way, the first erroneous installation prevention portions 10*a* and 10*b* of the ink tank are arranged on the front side of the end portion of the inserting direction of the ink tank in accordance with the present embodiment. For the first erroneous installation prevention portions, the nail 10*b* is arranged in four locations, and the protection wall 10*a* is also arranged in parallel to the longitudinal direction of the ink tank (that is, the direction in which the ink tank is installed on the ink tank unit) in order to protect the nails. By removing the unwanted portions from the nails, the prevention of the erroneous installation on the ink tank unit is effectuated. More specifically, the convex identification member is provided for the ink tank unit on which the ink tank is installed. Then, only the ink tank, for which the nail portion corresponding to the. convex identification member is removed, is allowed to be installed. As a result, before the ink supply port of the ink tank enters the interior of the ink tank unit, it is possible to reliably prevent the erroneous installation of the ink tank by means of the identification. member and the erroneous installation prevention portions. In accordance with the present embodiment, the arrangement is made so as to deal with four kinds of ink tank group by removing three nails appropriately out of the four nails provided for the first erroneous installation portions.

Also, for the ink tank of the present embodiment, the second erroneous installation prevention portions 10*c* and 10*d* are arranged between the first erroneous installation prevention portions and the first extrusion. For the second erroneous installation prevention portions, the nail portion 10*d* and the protection wall 10*c* are arranged as in the case of the first erroneous installation prevention portions. In accordance with the present embodiment, the nails are arranged in two line on six locations for the second erroneous installation prevention portions. Of these nails, three nails are removed in total, hence making it possible to deal with 20 kinds of ink tank group.

In accordance with the present embodiment, it is made possible to deal with 80 kinds (20×4) of ink tank group by the combinations of the erroneous installation prevention portions. However, the number of nails for the erroneous installation prevention portions is not necessarily limited to those described above. It is of course possible to select the number freely corresponding to the required number of the tank group.

Figure 8A:
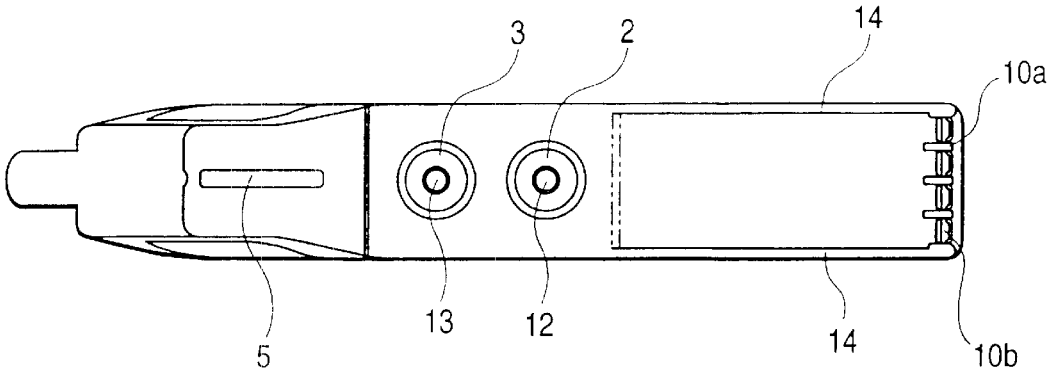
FIGS. 8A and 8B are the plan and side views which illustrate the variational example of the ink tank of the present invention, respectively.
Figure 8B:
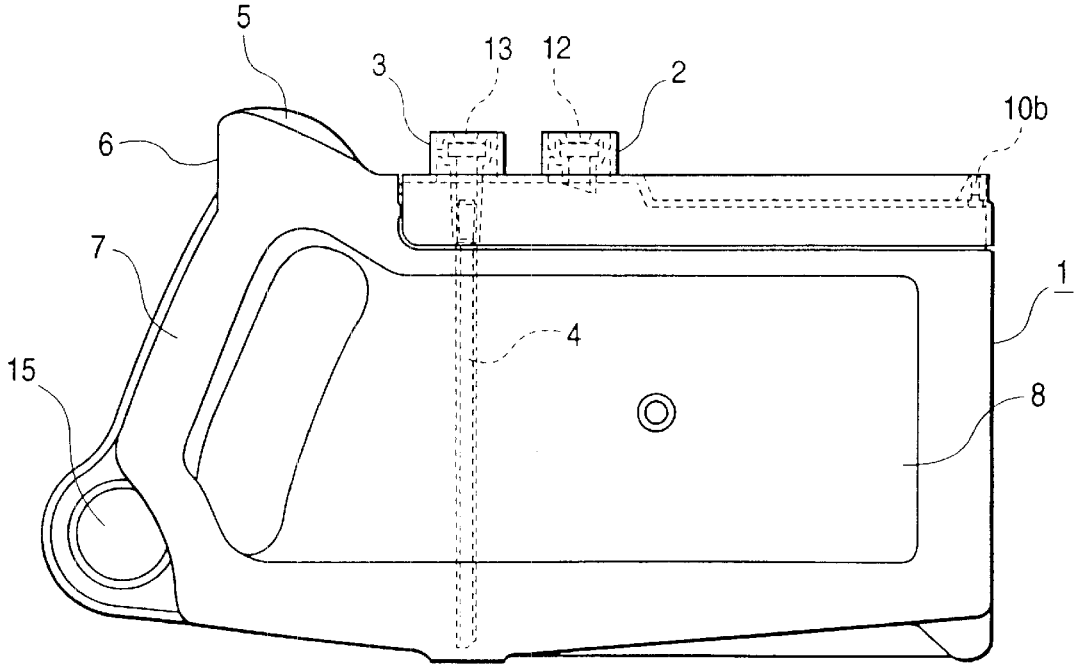

Also, since the first erroneous installation prevention portions are formed on the surface which lower by one step than the second erroneous installation prevention portions, there is no possibility that the convex identification member, which is arranged on the ink tank unit side to identify the second erroneous installation portions, is allowed to interfere with the first erroneous installation prevention portions. Also, the second erroneous installation prevention portions are arranged on the surface which is lower by one step than the first extrusion and the second extrusion. Therefore, the reference surfaces and bonding portions of the ink tank unit for positioning and bonding the ink tank are not allowed to interfere with the second erroneous installation prevention portions. As a result, the ink tank can be inserted smoothly, and at the same time, the space in the height direction of the ink tank can be utilized efficiently, hence making it possible to identify many kinds of ink tanks, that is, to identify them by the difference of colors, the difference in the recording apparatus on which each of them is mountable, and the like without making the size of the ink tank in the width direction (that is, the direction orthogonal to the inserting direction of the ink tank). In accordance with the present embodiment, the erroneous installation prevention portions are arranged over in two stages, but if the kinds of the ink tanks which should be identified are smaller, it may be possible to arrange them only in one stage as the variational example shown in FIGS. 8A and 8B.

Here, the plate member is colored in the same color as ink to be retained in the ink tank. Form the viewpoint that this coloring arrangement facilitates the user's recognition, the plate member should preferably be formed on the upper surface which is confronted with the bottom face of the ink tank. In order to enable the user to identify the tank to be used simply, it may be possible to attach a seal or the like to the plate member instead of coloring the plate member. However, as compared with the attachment of the seal, it is preferable to color the plate member in consideration of the prevention of any erroneous attachment of the identification label that may take place at the time of manufacture and at the time of injecting ink into the corresponding tank.

Here, as shown in FIG. 7A, the flat surface portion 9*b* and the flat surface portion 9*c* are positioned lower than the flat surface portion 9*a*. However, the side wall 14 is formed on the side face of the plate member of the present embodiment in a height which becomes almost the same as that of the flat surface portion 9*a*. The erroneous installation prevention portions 10*a*, 10*b*, 10*c* and 10*d* are in the same height as the side wall or formed lower than the said wall in the state shown in FIG. 7A, respectively. Therefore, if the operator should drop the ink tank unexpectedly, the side wall 14 functions to protect the first and second erroneous installation prevention portions.

On the other hand, the housing 8 comprises the opening portion 8*f* for the provision of the communication port with the air outside and the ink supply port, and the flat surface portion 8*b* and the flat surface portion 8*c* corresponding to the flat surface portion 9*b* and the flat surface portion 9*c* of the plate member, respectively. Then, the end part of the opening portion is formed in a slightly acute angled form as shown in FIG. 7B for the arrangement of the welded rib 8*e*. In this respect, a reference numeral 8*d* in FIGS. 6B and 6C designates the rib which is arranged for the enforcement of the housing.

Now, the plate member 9 of the present embodiment is formed by polypropylene as the housing 8. Then, the plate member is formed by the injection molding, and the housing is formed by the blowing molding, respectively. In this manner, the housing and the plate member are formed by olefin resin which is the thermo-plastic resin excellent in recycling capability so as to make it easier to perform reproduction or reutilization.

The ink tank 1 of the present invention is manufactured in such a manner that the housing 8 and the plate member 9 are formed each individually, and then, bonded by means of ultrasonic welding, while the communication port with the air outside 12 and the ink supply port 13 of the plate member are being positioned exactly with the opening portion 8*f* of the housing. As the bonding method, it may be possible to adopt the vibration welding, the hot plate welding, or the like or bond them by use of a bonding agent, beside the ultrasonic welding described above.

Now, in conjunction with FIGS. 9A and 9B, 10A to 10C, 11A to 11C and 12, the supplement description will be made of the method for manufacturing the aforesaid ink tank.

Figure 10A:
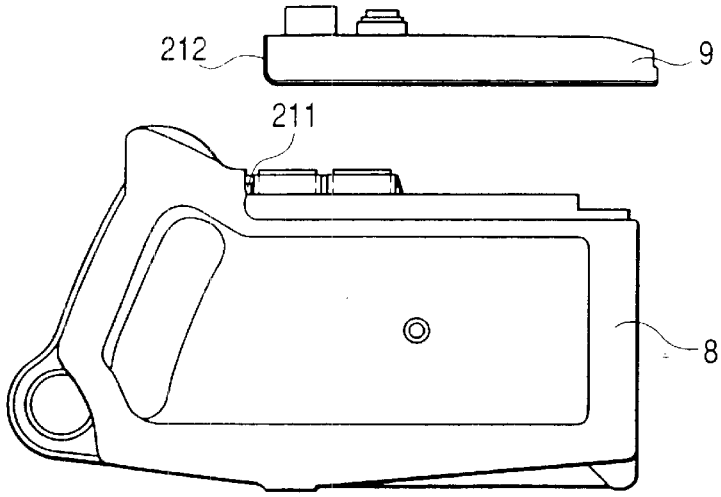
FIGS. 10A, 10B and 10C are views which schematically illustrate the manufacturing process of the ink tank of the present invention.
Figure 10B:
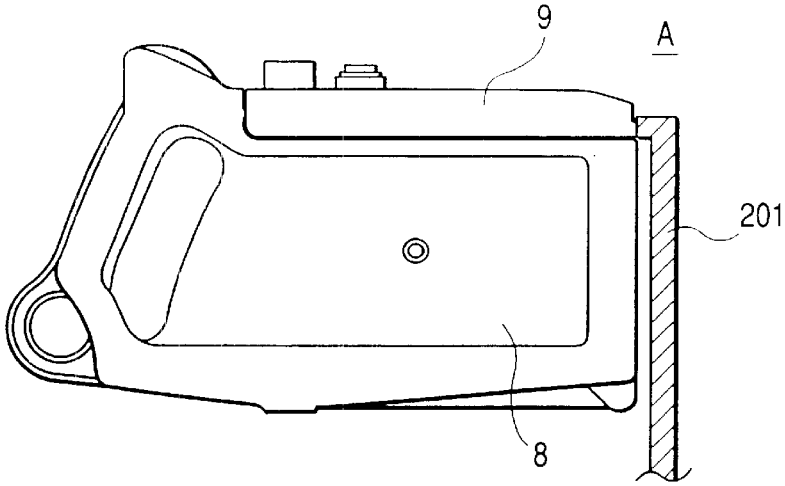
Figure 10C:
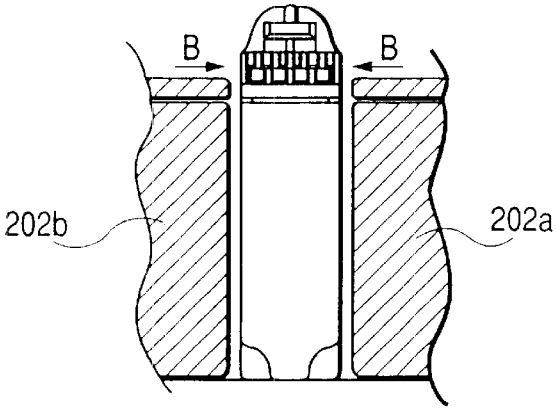

As shown in FIG. 10A, the housing 8 and the plate member 9 are formed each individually. Then, as shown in FIGS. 10B and 10C, using the pressure members 201, 202*a* and 202*b* the plate member 9 is positioned to the housing 8. Here, the communication port with the air outside 12 and the ink supply port 13 of the plate member are arranged to face the opening portion 8*f* of the housing, respectively. At this juncture, in the depth direction of the tank, the positioning extrusion 211 provided for the housing and the positioning portion arranged for the plate member 9 abut upon each other by the pressure exerted by the pressure member 201 in the direction indicated by an arrow A as shown in FIG. 10B, hence the position being determined. On the other hand, in the width direction of the tank, both the housing 8 and the plate member 9 are being pressured by the pressure members 202*a* and 202*b* in the direction indicated by an arrow B, respectively, as shown in FIG. 10C, hence positioning them. In this way, in the width direction and the depth direction, the two directions which are orthogonal to the height direction of the ink tank (that is, the direction in which the needle is inserted from the recording apparatus to the ink supply port 13) and which intersect each other at the same time, each positioning is executed to install the ink tank on the recording apparatus. Therefore, it becomes possible to enhance the positional precision in the horizontal direction for the hollow needle on the ink supply port and recording apparatus sides when the ink tank is installed on the recording apparatus for use. As to the vertical direction which is the inserting direction of the needle into the ink supply port, the amount of insertion of the needle is predetermined to make it possible to perform the reliable coupling even if the positional precision cannot be secured strictly.

Figure 7D:
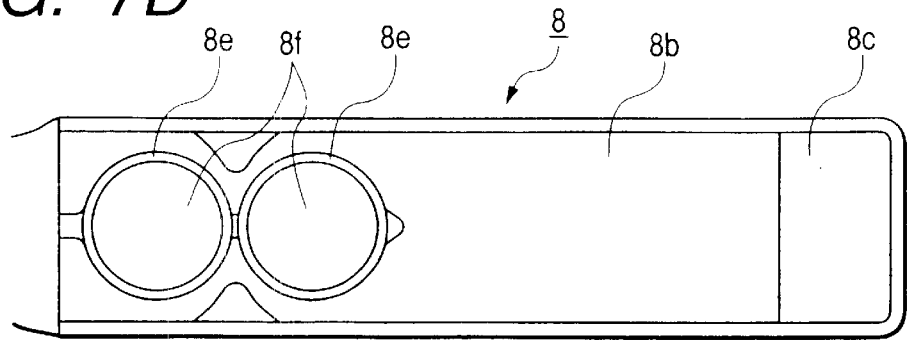
Figure 11A:
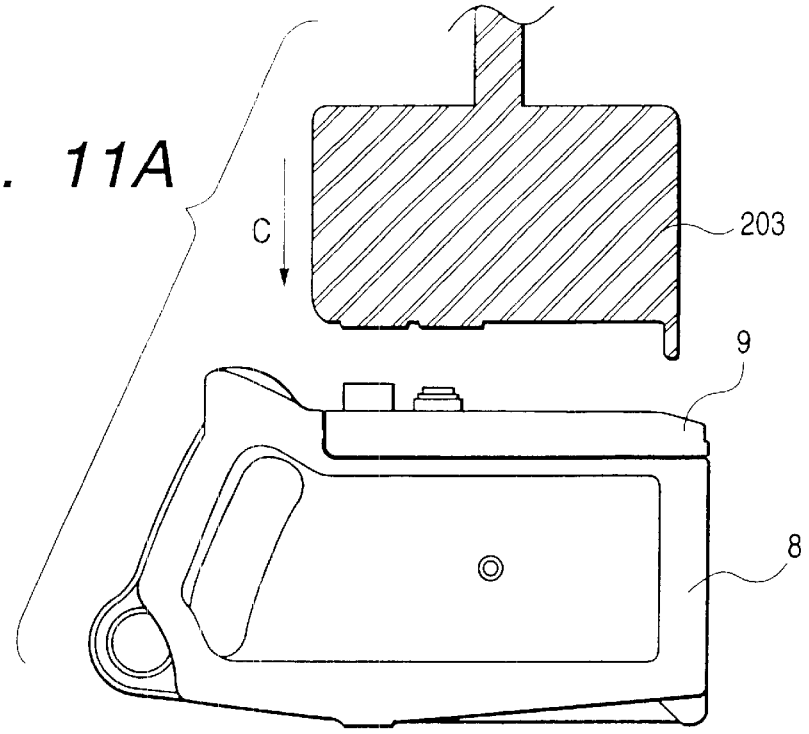
FIGS. 11A, 11B and 11C are views which schematically illustrate the manufacturing process of the ink tank of the present invention.
Figure 11B:
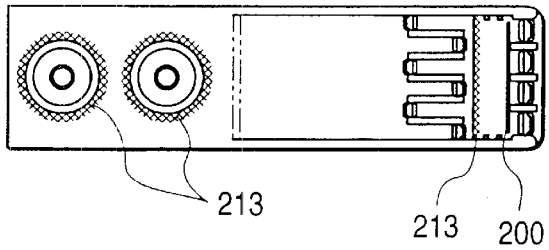
Figure 11C:
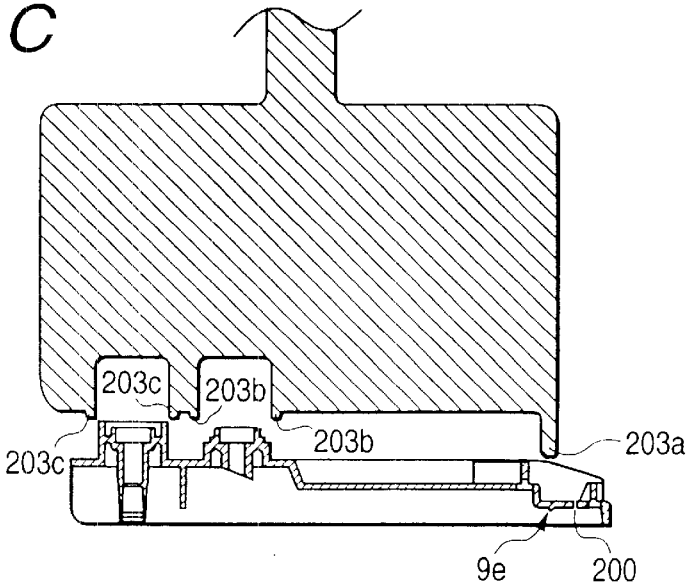

Now, as shown in FIG. 11A, the welding horn 203 is in contact with the plate member 9 from above to join the plate member 9 and the housing 8 by means of the ultrasonic welding, while pressing them in the direction indicated by an arrow C. Here, as shown in FIG. 11C, the extrusions 203*a*, 203*b*, and 203*c* are provided for the welding horn 203 so that the vibrations of the horn can be concentrated. Then, as shown in FIG. 11B, the portion abuts upon the plate member 9 on the welding horn abutting portion 213. As shown in FIG. 7D, the welding rib 8*e* is provided for the abutting portion of the welding horn in accordance with the present embodiment. Then, on the plate member side which is bonded to this portion, the flat surface portion 9*a* is arranged. In this manner, when the ultrasonic welding is performed, resin is fused centering on the housing side, hence bonding the plate member to the housing. Here, in consideration of the resistance to shock when dropped down, the welded rib is provided for the plate member 9 (on the flat surface portion 9*c* on the end portion on the side opposite to the position where the ink supply port is provided), and welded by means of the ultrasonic welding to the flat surface portion 8*c* on the housing side which is bonded to this portion.

Now, as has been described above, in the height direction of the ink tank (that is, the inserting direction of the needle from the recording apparatus to the ink supply port 13), the welding horn is in contact with the ink tank for the performance of the ultrasonic welding. Thus, the welding portion is secured reliably because the portion, which the welding rib provided for either the housing or the plate member is arranged to abut upon, is configured to be the flat surface. As a result, the welding portion can be secured reliably, and even when the ink tank should drop down, there is almost no fear that the plate member is caused to part from the plate member, thus providing a highly reliable ink tank. Also, with the welding positions of the welded rib 9*e* and the welded rib 8*e* being arranged apart from each other in the vicinity of the erroneous installation prevention portions, it is made possible to avoid any influence that may be exerted on the other welding portion by the heat and vibrations at the time of welding each of the ribs to be welded. Therefore, even if the configuration of the erroneous installation prevention portions become more complicated, there is almost no fear that such portions are distorted at the time of welding. Also, when the ink supply port is welded, the welding rib is arranged for the opening portion of the housing so as to prevent the external leakage of ink retained in the interior of the housing, which may be caused by the portions yet to be welded.

In this respect, the welding is made between the ink supply port and the communication port with the air outside of the plate member, and the housing, and then, it has been described that the abutting surface of the plate member on the housing is arranged to be the flat surface, and the welding rib is provided for the portion where the portion of the housing that abuts upon the plate member. However, it may be possible to arrange the welding rib on the plate member side, and arrange the portion of the housing that abuts upon the welding rib to be the flat surface.

Figure 9A:
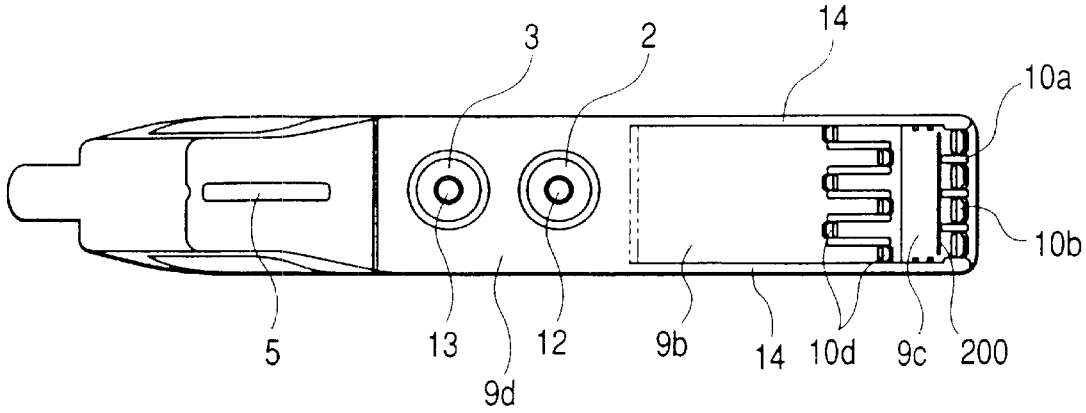
FIGS. 9A and 9B are the plan and side views which illustrate the variational example of the ink tank of the present invention, respectively.
Figure 9B:
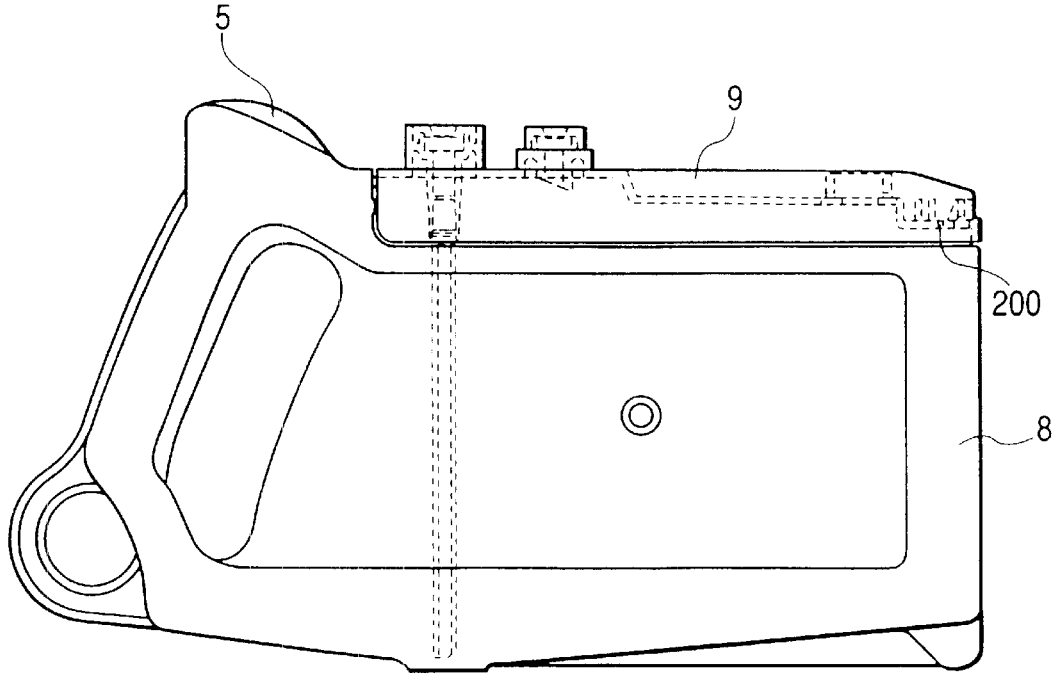

Also, as the variational example shown in FIGS. 9A and 9B, it is preferable to arrange the slit 200 on the vicinity of the erroneous installation prevention, because such arrangement can easily prevent the deformation of the erroneous installation portions that may be caused by the propagation of the vibrations from the abutting portion 213 of the welding horn.

Figure 12:
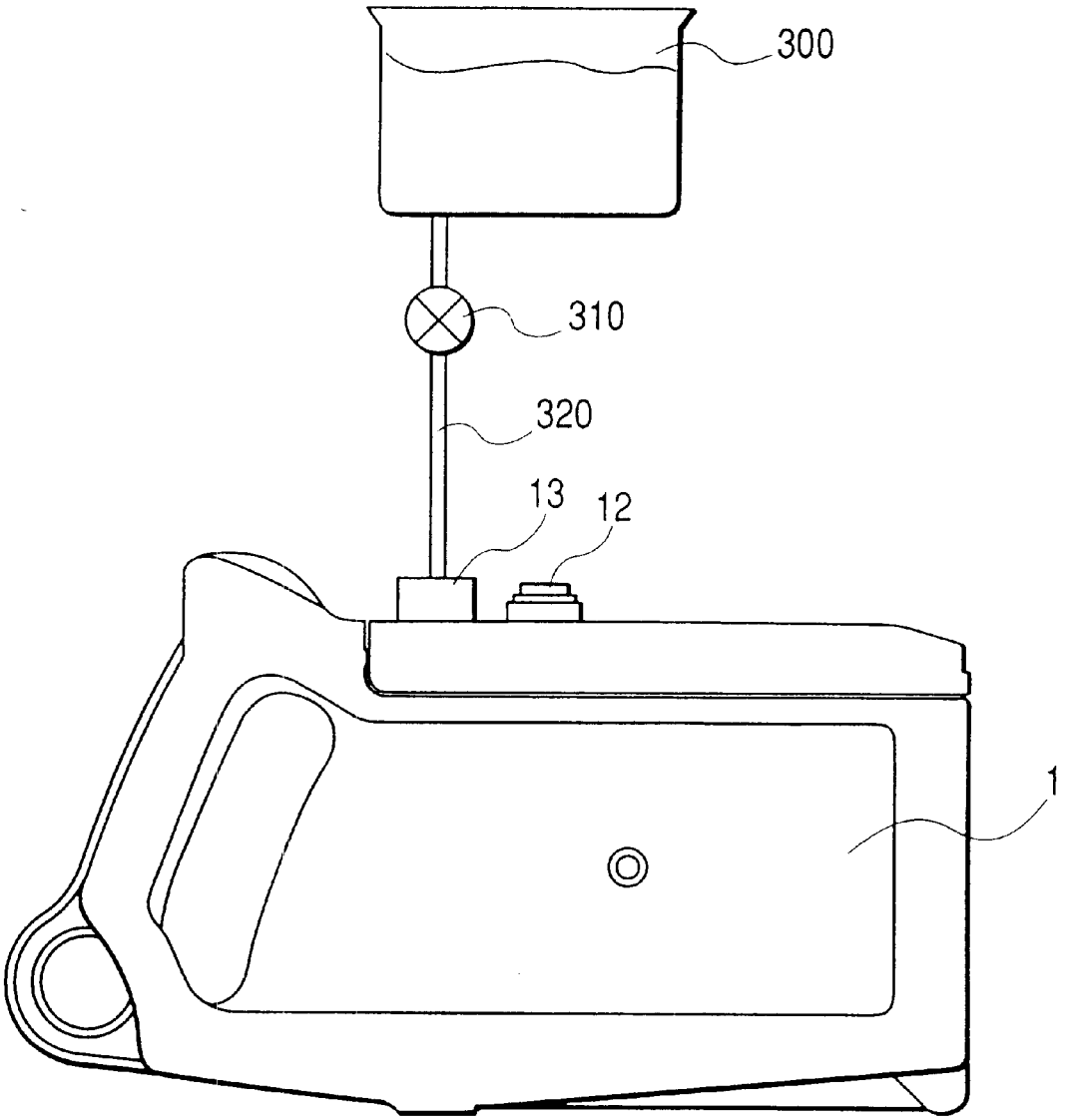
FIG. 12 is a view which schematically illustrates the manufacturing process of the ink tank of the present invention.

Now, as shown in FIG. 12, ink is injected into the ink tank 1 with the plate member 9 being fixed to the housing 8 as has been described, and the ink tank is complete when plugged with the plug (not shown). When ink is injected into the interior of the ink tank, the ink injection tube 320 is connected with either one of the ink supply port 13 and the communication port with the air outside 12, and the other one of them is arranged to exhaust the air from the interior of the housing as shown in FIG. 12, for example. In this state, the valve 310 is released. Thus, it becomes possible to inject ink from the ink storage unit 300 of the ink injection device. After a specific amount of ink has been injected, the valve 310 is closed, and with the identification label being attached, the ink tank is completed. Here, as to the erroneous installation prevention portions, it may be possible to remove the nails before the ink injection corresponding to the ink which should be used or it may be possible to remove the nails after the ink injection corresponding to the ink which should be used.

Here, for the ink tank shown in FIGS. 6A to 6C, the tube 4 is arranged on the ink supply port side. This tube should preferably be installed on the plate member 9 before the plate member 9 is positioned to the housing 8. In this case, after the completion of the ink tank, the in injection tube 320 of the device shown in FIG. 12 is connected with the ink supply port, while the air in the interior of the housing is exhausted from the communication portion with the air outside. Then, the valve 310 is released to make it possible to inject ink from the ink storage unit 300 of the ink injection device.

In accordance with the present embodiment, the plate member that requires the functionability is formed by the injection molding whereby the dimensional precision can easily be obtained. Then, for the housing whose main purpose is to retain ink in it, the hollow container is formed by the blow molding at comparatively low costs, although the dimensional precision is not easily obtainable. Subsequently, both of them are integrated to make the variation of the dimensional precision smaller, which is required for the installation and bonding. At the same time, it is made possible to lower the overall manufacturing costs than the case where the ink tank is formed by the injection molding as a whole. In this manner, with the ink tank of the present invention, it becomes possible to enhance only the dimensional precision of the coupling portion with the recording apparatus and the erroneous installation prevention portions. Therefore, the installation on the recording apparatus or the coupling reliability can be enhanced without depending on the accuracy of the ink tank as a whole.

In the description which has been made above, the polypropylene resin, which is the same thermo-plastic resin with which the housing is made, is used for the plate member, and then, formed by means of the injection molding. However, if only bonding with the housing is possible, the material is not necessarily limited to the thermoplastic resin. It may be possible to use metal. In this case, it is preferable to adopt the method of manufacture that provides the best precision depending on the selected material.

What is claimed is:

1. A method for manufacturing an ink tank detachably mountable on a liquid jet recording apparatus, said ink tank having a housing constructed to retain liquid directly in an interior thereof, a supply portion for supplying the liquid retained in said housing to said liquid jet recording apparatus, and a communication portion for communicating the interior of said housing with the air outside, said ink tank being insertable in said liquid jet recording apparatus in an insertion direction, and said supply portion and said communication portion both being connectable to said liquid jet recording apparatus in a connection direction substantially perpendicular to said insertion direction, said method comprising the following steps of:

preparing a plate member provided with said supply portion and said communication portion on the same surface, said plate member being provided with erroneous installation prevention portions for preventing installation of said ink tank on a position other than that specifically designated for said liquid jet recording apparatus;

positioning said plate member with respect to said housing, wherein said plate member is positioned in two directions orthogonal to the insertion direction, the two directions intersecting each other with respect to said housing; and welding said plate member to said housing, whereby said plate member is joined to said housing to make the interior thereof a substantially closed space.

2. A method for manufacturing an ink tank according to claim 1, further comprising the step of filling ink in the interior of said housing after said welding step.

3. An ink tank manufactured by the method according to claim 1.

4. A method for manufacturing an ink tank detachably mountable on a liquid jet recording apparatus, said ink tank having a housing constructed to retain liquid directly in an interior thereof, a supply portion for supplying the liquid retained in said housing to said liquid jet recording apparatus, and a communication portion for communicating the interior of said housing with the air outside, said ink tank being insertable in said liquid jet recording apparatus in an insertion direction, said method comprising the following steps of:

preparing a plate member provided with said supply portion and said communication portion on the same surface, said plate member being provided with erroneous installation prevention portions for preventing installation of said ink tank on a position other than that specifically designated for said liquid jet recording apparatus;

positioning said plate member with respect to said housing, wherein said plate member is positioned in two directions orthogonal to the insertion direction, the two directions intersecting each other with respect to said housing; and welding said plate member to said housing, whereby said plate member is joined to said housing to make the interior thereof a substantially closed space;

wherein said plate member is provided with slits in the vicinity of said erroneous installation prevention portions, and wherein a jig for welding said plate member to said housing in said welding step abuts upon an area at a side opposite to said erroneous installation prevention portions through said slits.

5. A method for manufacturing an ink tank detachably mountable on a liquid jet recording apparatus, said ink tank having a housing constructed to retain liquid directly in an interior thereof, a supply portion for supplying liquid retained in said housing to said recording apparatus, and a communication portion for communicating the interior of said housing with the air outside, said ink tank being insertable in said liquid jet recording apparatus in an insertion direction, and said supply portion and said communication portion both being connectable to said liquid jet recording apparatus in a connection direction substantially perpendicular to said insertion direction, said method comprising the following steps of:

sealing said housing with a plate member provided integrally with erroneous installation prevention portions for preventing installation of said ink tank on a position other than that specifically designated for said liquid jet recording apparatus, said plate member further being provided with said supply portion and said communication portion, whereby in said sealing step, the interior of said housing is made a substantially closed space by joining said plate member to said housing; and injecting ink through either one of the communication portion and the supply portion of said ink tank, while exhausting air in the interior of said housing from the other portion.

* * * * *

UNITED STATES PATENT AND TRADEMARK OFFICE

CERTIFICATE OF CORRECTION

PATENT NO. : 6,467,889 B2
DATED : October 22, 2002
INVENTOR(S) : Kyota Miyazaki et al.

It is certified that error appears in the above-identified patent and that said Letters Patent is hereby corrected as shown below:

Column 1,
Line 21, "deliver" should read -- delivery --; and
Line 29, "the some others material" should read -- some other materials --.

Column 2,
Line 27, "here of" should read -- hereof --.

Column 3,
Line 40, "os" should read -- of --; and
Line 42, "the-present" should read -- the present --.

Column 5,
Line 7, "2" should read -- 102 --; and
Line 40, "side" should read -- a side --.

Column 6,
Line 2, "tank" should read -- tank 1. --;
Line 25, "designates" should read -- designate --; and
Line 51, "draw" should read -- drawn --.

Column 7,
Line 57, "designated" should read -- designates --.

Column 10,
Line 58, "the." should read -- the --.

UNITED STATES PATENT AND TRADEMARK OFFICE

CERTIFICATE OF CORRECTION

PATENT NO. : 6,467,889 B2
DATED : October 22, 2002
INVENTOR(S) : Kyota Miyazaki et al.

It is certified that error appears in the above-identified patent and that said Letters Patent is hereby corrected as shown below:

Column 11,
Line 8, "line" should read -- lines --; and
Line 21, "lower" should read -- is lower --.

Column 14,
Line 23, "in" should read -- ink --.

Signed and Sealed this

Twenty-fifth Day of March, 2003

JAMES E. ROGAN
*Director of the United States Patent and Trademark Office*